US006296951B1

(12) United States Patent
Tateishi et al.

(10) Patent No.: US 6,296,951 B1
(45) Date of Patent: Oct. 2, 2001

(54) LAMINATED CHROMIUM PLATING LAYERS HAVING SUPERIOR WEAR RESISTANCE AND FATIGUE STRENGTH

(75) Inventors: Yukio Tateishi; Motonobu Onoda; Katsuaki Ogawa; Kazuo Shimizu, all of Yono (JP)

(73) Assignee: Nippon Piston Ring Co., Ltd., Saitama-Ken (JP)

( * ) Notice: Subject to any disclaimer, the term of this patent is extended or adjusted under 35 U.S.C. 154(b) by 0 days.

(21) Appl. No.: 09/339,811

(22) Filed: Jun. 25, 1999

(30) Foreign Application Priority Data

Jun. 26, 1998 (JP) ..... 10-196537

(51) Int. Cl.[7] ..... B32B 15/00

(52) U.S. Cl. ..... 428/635; 428/636; 428/666; 428/667; 428/935

(58) Field of Search ..... 428/666, 667, 428/635, 636, 935; 205/179, 103

(56) References Cited

U.S. PATENT DOCUMENTS

| | | | | |
|---|---|---|---|---|
| H543 | * | 11/1988 | Chen et al. | 428/635 |
| 2,993,264 | * | 7/1961 | Grenoble | 29/183.5 |
| 3,421,986 | * | 1/1969 | Ruff et al. | 204/36 |
| 3,770,286 | * | 11/1973 | Angilella et al. | 277/235 A |
| 4,278,512 | * | 7/1981 | Barclay et al. | 204/41 |
| 4,293,620 | * | 10/1981 | Vigar | 428/667 |
| 4,461,680 | | 7/1984 | Lashmore | 204/41 |

FOREIGN PATENT DOCUMENTS

| | | | |
|---|---|---|---|
| 41 16 686 A1 | 12/1991 | (DE) | C25D/5/10 |
| 147484 * | 7/1985 | (EP) . | |
| 0 147 484 A1 | 7/1985 | (EP) | C25D/5/14 |
| 0 330 722 A1 | 9/1989 | (EP) | C25D/5/18 |
| 2 586 711 | 6/1987 | (FR) | C25C/3/04 |
| 2602499 | 1/1997 | (JP) | C25D/15/00 |
| 10-53881 | 2/1998 | (JP) | C23C/30/00 |

* cited by examiner

*Primary Examiner*—John J. Zimmerman
(74) *Attorney, Agent, or Firm*—Sughrue, Mion, Zinn, Macpeak & Seas, PLLC

(57) ABSTRACT

A laminated chromium plating layers providing improved wear resistance and fatigue strength for use in mechanical parts of an internal combustion engine. The lamination is formed on a base body and contains a plurality of high hardness chromium plating layer and a plurality of low hardness chromium plating layer, and each high hardness chromium plating layer is formed upon each low hardness chromium plating layer to provide the lamination of alternating high hardness chromium plating layer and low hardness chromium plating layer.

5 Claims, 2 Drawing Sheets

LAMINATED CHROMIUM PLATING LAYERS HAVING SUPERIOR WEAR RESISTANCE AND FATIGUE STRENGTH

BACKGROUND OF THE INVENTION

The present invention relates to a laminated chromium plating layers and a method for producing the same wherein the lamination of chromium plating is applied to sliding components used in internal combustion engine, such as the outer peripheral surface or the end face of a piston ring, the inner peripheral sliding surface of a cylinder liner, the sliding surface of a rocker arm, the outer peripheral surface of a cam lobe of a cam shaft, or a journal portion.

Recently, demand for internal combustion engine with highly efficient fuel consumption rate, high output, and the like has strengthened. In association with this, the load on various components in the internal combustion engine, such as on piston rings, has continually increased.

Conventionally, to deal with improvements in performance, such as in wear resistances of piston rings for internal combustion engine and in the thermal seizure resistance of cylinder liners, the friction surface of the piston rings and the cylinders are plated with high hardness chromium, which has superior wear resistance and thermal seizure resistance.

Conventionally, chromium plating is formed continuously without any layer boundaries. Moreover, the chromium plating portion is formed with a fixed hardness throughout. During frictional sliding operation, a chromium plating layer having a configuration of a single layer receives a strong force from the chromium plating surface in the sliding direction. Also, at a combustion stage in the engine, the layer receives a strong impact force. However, conventional single layer chromium plating formed continuously has high hardness, so that a toughness of the layer is insufficient and the layer has low anti-breakage limits. Generally, "toughness" implies resistance against breakage due to the application of external force. Low toughness implies high tensile strength, and high toughness implies high compression strength without longer elongation.

Japanese Patent Application Publication (Kokai) No. HEI-10-53881 discloses a laminated chromium plating layers which is an improvement on the conventional single chromium plating layer in order to improve wear resistance. According to the disclosed technique, a thin high hardness chromium plating layer is repeatedly precipitated, to form a lamination of chromium plating layers having many minute cracks that is independent in the direction of lamination thickness. That is, the minute cracks become closed cells when the upper plating layer is formed on the lower plating layer. By this, the amount of oil retained in the minute cracks in the chromium plating increases. More specifically, even if the upper plating layer is frictionally worn, the lower plating layer can newly provide oil retaining recesses at the minute crack portions to maintain oil retainability. Thus, wear resistance can be improved.

However, in a portion of internal combustion engine, the above-described conventional high hardness chromium plating can no longer sufficiently deal with required performance in terms of wear resistance and fatigue strength. That is, even though the high hardness chromium plating has sufficient wear resistance because of high hardness of the plating layer and because of the oil retaining function of the minute cracks. However, high hardness of the plating layer increases a modulus of elasticity (becomes excessively rigid). At the same time, the minute cracks provide the notch effect, so that repeated load during engine rotation invites the cracks to enlarge, ending in a danger of breakage. The present fatigue strength is insufficient for dealing with this problem.

Also, there is a problem with the laminated chromium plating layers that are formed by repeatedly precipitating thin high hardness chromium plating layer while forming independent minute cracks in the direction of layers, in that it has as large a modulus of elasticity as ever since each layer is formed of the high hardness chromium plating film. Thus, such conventional layers also provide low fatigue strength.

Japanese Patent No. 2602499 discloses a chromium plating layer in which the minute cracks are formed, and solid high hardness particles are supported in gaps of the minute cracks to improve wear resistance of the chromium plating layer. The chromium plating layer containing high hardness particles may increase frictional wearing of the opponent sliding layer. Further, the chromium plating layer containing high hardness particles must have minute cracks with width broadened to the diameter of the high hardness particles. Therefore, such arrangement increases notch effect to further lower the fatigue resistance, even though wear resistance can be increased.

In order to solve these problems, it is presently strongly desired that a film material capable of providing a high function improved over the conventional chromium plating be obtained at a low price.

SUMMARY OF THE INVENTION

It is an object of the present invention to provide an improved laminated chromium plating layers having performance superior to that of the conventional chromium plating in order to improve wear resistance and fatigue strength of internal combustion engine components, while making use of the advantage of chromium plating which is inexpensive to produce.

This and other object of the present invention will be attained by providing a laminated chromium plating layers formed on a surface of a base body, the lamination including high hardness chromium plating layers, and low hardness chromium plating layers with hardness lower than hardness of the high hardness chromium plating layers, the high hardness chromium plating layers and the low hardness chromium plating layers being laminated in alternation. Thus alternating layers can provide superior fatigue strength and wear resistance. The present inventors noticed a chromium plating having a laminate configuration with alternating combination of high hardness chromium plating layers and low hardness chrome layers. The present inventors accomplish the invention by forming such a chromium plating on the sliding surface of a sliding components of the internal combustion engine, typically a piston ring.

Preferably, a thickness of each high hardness chromium plating layer is greater than that of the low hardness chromium plating layer. Further, the high hardness chromium plating layers preferably has a hardness ranging from Hv750 to HV1200, and a hardness of the low hardness chromium plating layers is lower than the hardness of the high hardness chromium plating layers. Furthermore, the thickness of each high hardness chromium plating layer is preferably 2–50 $\mu$m, and thickness of each low hardness chromium plating layer is preferably 0.1–40 $\mu$m. Furthermore, a first chromium plating layer plated on the surface of the base body is one of the high hardness chromium plating layer and the low hardness chromium plating layer, and preferably has a thickness of 0.1–50 $\mu$m.

DETAILED DESCRIPTION OF THE PREFERRED EMBODIMENT

Figure 1:
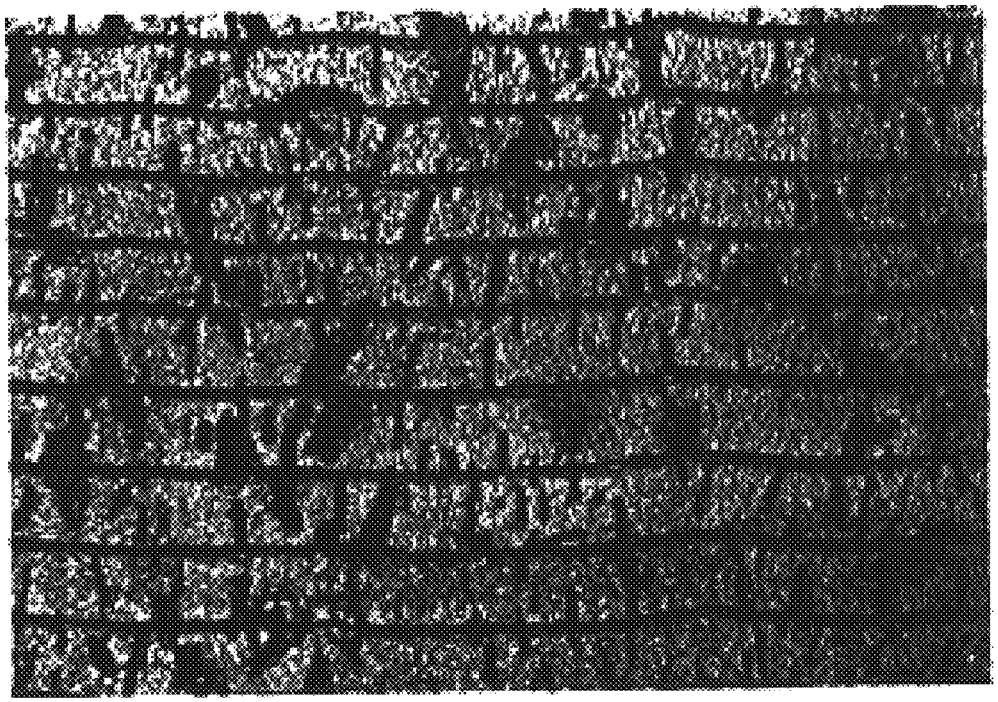
FIG. 1 is a microscopic photograph taken at 400 magnification showing a chromium plating layers corroded with an aqua regia according to one embodiment of the present invention.

Laminated chromium plating layers according to one embodiment of the present invention will be described with reference to accompanying drawings.

The lamination includes high hardness chromium plating layers and low hardness chromium plating layers in alternating relation thereto. Each high hardness chromium plating layer has a hardness of Hv750–1200. If the hardness is lower than Hv750, sufficient wear resistance cannot be obtained. If the hardness exceeds Hv1200. the wear resisting performance is saturated and an opposing sliding member will be excessively worn. Because of this range, the chromium plating layer has sufficient wear resistance. The hardness of the low hardness chromium plating layer is lower than that of the high hardness chromium plating layer. Because of this, each low hardness chromium plating layer can serves as a resilient part. The low hardness chromium plating layer of the present embodiment has lower hardness than that of the high hardness chromium plating layer to enhance toughness. Therefore, the combination of alternating high and low hardness chromium plating layers has a superior anti-breakage characteristic in comparison with the conventional single layer chromium plating formed continuously as a chromium plating film overall or a chromium plating having a laminated configuration.

The laminated chromium plating layers of the present embodiment requires wear resistance at the same time. Therefore, the thickness of the high hardness chromium plating layer needs to be 2 to 50 $\mu$m, and the thickness is greater than that of the low hardness chromium plating layers having a thickness of 0.1 to 40 $\mu$m. If the thickness of each high hardness chromium plating layer is less than 2 $\mu$m, sufficient wear resistance may not be obtained. On the other hand. If the thickness of each high hardness chromium plating layer is more than 50 $\mu$m, the occupying ration of the low hardness chromium plating layer becomes excessively small, and therefore, sufficient resiliency cannot be obtained. If the thickness of each low hardness chromium plating layer is less than 0.1 $\mu$m, sufficient resiliency may not be obtained. On the other hand, if the thickness of each low hardness chromium plating layer is more than 40 $\mu$m, the occupying ratio of the high hardness chromium plating layer becomes excessively small, and therefore, sufficient wear resistance cannot be obtained.

The laminated chromium plating layers of the present embodiment can obtain predetermined wear resistance and anti-breakage characteristic by selectively combining two conditions of thickness and hardness of the high hardness chromium plating layer and the low hardness chromium plating layer.

A top surface portion of the lamination of the chromium plating layers can provide greater toughness than the other part, if the high hardness chromium plating layer having a thickness of 0.1 to 50 $\mu$m is initially formed on the surface of the base body as a first layer, and if the low hardness chromium plating layer and the high hardness chromium plating layer are alternatingly precipitated on the first layer. In this case, if the thickness of the first layer (high hardness chromium plating layer) is less than 0.1 $\mu$m, it is impossible to provide only the top surface portion of the chromium plating layer with great toughness. Rather, entire laminated construction has greater toughness. On the other hand, if the thickness of the first layer is 50 $\mu$m or more, the resilient layer in the entire chromium plating is reduced, so that it is impossible to provide only the surface portion of the chromium plating with the greater toughness.

An entire lamination of the chromium plating layers can provide greater toughness, if the low hardness chromium plating layer having a thickness of 0.1 to 50 $\mu$m is initially formed on the surface of the base body as a first layer, and if the high hardness chromium plating layer and the low hardness chromium plating layer are alternatingly precipitated on the first layer. If a thickness of the first layer is less than 0.1 $\mu$m, it is impossible to impart resiliency on the entire lamination. On the other hand, if the thickness exceeds 50 $\mu$m, the resilient layer parts (i.e., low hardness layers) occupy greater proportion than the wear resistant layer parts (i.e., high hardness layers) in the entire lamination, so that the entire thickness of the high hardness layers becomes thinner to reduce wear resistance.

Next, a method for producing the lamination of the chromium plating layers according to the present embodiment will be described in the order of manufacturing processes.

(1) Degreasing process: First, fat and oil is cleaned from the surface of the base body by applying evaporated organic solvent such as trichloroethylene to the surface.

(2) Acid wash process: Next, the base body is emerged for 15 to 300 seconds in hydrochloric acid that has been heated to 30 to 80° C., to remove oxidized materials and the like from the surface of the base body and to expose a clean surface of the base body material.

(3) Liquid honing process: Further, aqueous solution containing high hardness particles such as ceramic suspended therein is pressurizingly jetted (2 to 10 kg/mm$^2$) uniformly over the entire surface of the base body. The surface of the base body is polished to satin finish to improve bonding strength to the plating layer.

(4) Electrolytic polishing process: The base body functioning as an anode is inserted into a plating vat, and current density of 20 to 100 A/dm$^2$ is applied for 10 to 120 seconds in co-operation with a counter electrode as a cathode.

(5) High or low hardness layer forming process: The polarity of the base body and the counter electrode is rapidly inverted after process (4) so that the base body becomes the cathode and the counter electrode becomes the anode. The current density in the range of 30 to 120 A/dm$^2$ is applied for a time within a range of 2 to 80 minutes, to precipitate the high hardness or low hardness chromium plating layer as a first layer and to control the thickness of the chromium plating layer. Here, the current density level determines the hardness of the chromium plating layer. If the current density exceeds a predetermined level, the high hardness chromium plating layer can be formed. If the current density is less than the predetermined level, the low hardness chromium plating layer can be formed.

(6) Inverse polarity process: The polarity is rapidly inverted after process (5) so that the base body becomes the anode and the counter electrode becomes the cathode. A current density in the range of 20 to 100 A/dm$^2$ is applied for a time within the range of 10 to 120 seconds to cause elution of the plating layer. During elution of the plating layer, minute cracks are generated at the surface thereof. As a result of the elution, the chromium plating layer retains a predetermined thickness.

(7) High hardness chromium plating process: Polarities are rapidly inverted after process (6) so that the base body becomes the cathode and the counter electrode becomes the anode. A current density within a range of 30 to 120 A/dm$^2$ is applied for a time within a range of 2 to 80 minutes, in order to precipitate a high hardness chromium plating layer having a predetermined thickness.

(8) Inverse polarity process: The polarity is rapidly inverted after process (7) so that the base body becomes the anode and the counter electrode becomes the cathode. A current density within a range of 20 to 100 A/dm$^2$ is applied for a time within a range of 10 to 120 seconds to perform elution of the high hardness chromium plating layer, in order to obtain a predetermined thickness of the layer after the elution.

(9) Low hardness chromium plating process: Then, the polarity is rapidly inverted after process (8) so that the base body becomes the cathode and the counter electrode becomes the anode. A current density within the range of 30 to 100 A/dm$^2$ is applied for a time within the range of 2 to 75 minutes, to precipitate the low hardness chromium plating layer, which has a lower hardness than that of the high hardness chromium plate layer of process (7), to a predetermined layer thickness.

(10)Inverse polarity process: The polarity is rapidly inverted after process (9) so that the base body becomes the anode and the counter electrode becomes the cathode. A current density within the range of 20 to 100 A/dm$^2$ is applied for a time within the range of 10 to 120 seconds, to perform elution of the low hardness chromium plating layer precipitated in process (9) in order to obtain a predetermined thickness thereof.

(11) Repetition process: Processes (7) to (10) are repeated until a preset thickness of the lamination is achieved. Finally, a high hardness chromium plating layer in accordance with process (7) is precipitated as a top layer and processes are completed.

FIG. 1 shows a microscope photograph (400 magnification) of the resultant chromium plating layers. Cross-sectional surfaces of the chromium plating layer are corroded with an aqua regia. A laminated configuration of the several chromium plating layers on the surface of the base body (not shown) can be seen. Black colored portion extending horizontally are the low hardness chromium plating layers. The thick white colored portions sandwiched between the low hardness chromium plating layers are the high hardness chromium plating layers. The present invention will be described hereinafter by way of examples and comparative examples.

Example 1

A laminated chromium plating layers with high hardness chromium plating layers and low hardness chromium plating layers in alternation was obtained using the chromium plating production method of the present invention. The high hardness chromium plating layers had hardness of Hv1000 and layer thickness of 10 $\mu$m. The low hardness chromium plating layers had hardness of Hv600 and layer thickness of 2 $\mu$m.

Figure 2:
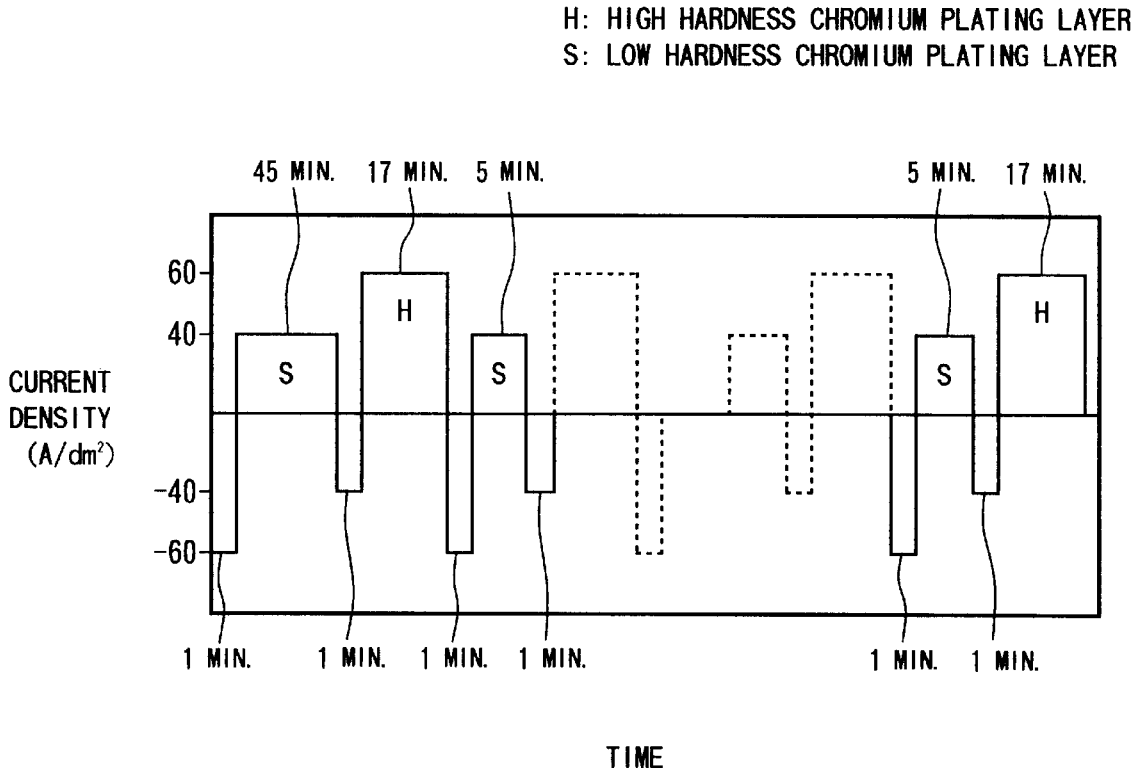
FIG. 2 is a graph for description of a production method of the chromium plating layers according to one Example of the present invention.

The chromium plating conditions and plating processes according to Example 1 will be described while referring to FIG. 2.

A chromium plating film bath containing $CrO_3$:250g/liter and $SO_4$:2.58/liter was maintained at a fixed temperature of 55° C. A sodium silicofluoride additive was added to the chromium plating bath liquid. The resultant chromium plating bath liquid was used to perform chromium plating in the order of the following processes (1) and (7).

(1) First, with the base body as the anode and a counter electrode formed of a tin-lead alloy as the cathode, electrolytic polishing was performed on the outermost surface of the base body. This polishing is based on electrical elution on the outermost surface of the base body by using a current control power source unit to apply for one minute a selective fixed current corresponding to 60 A/dm$^2$.

(2) Next, the cathode and the anode were rapidly inverted and selective fixed current corresponding to 40 A/dm$^2$ was applied for 45 minutes using the current control power source unit to precipitate a low hardness chromium plating layer.

(3) The cathode and the anode were rapidly inverted and a selective fixed current corresponding to 40 A/dm$^2$ was applied for one minute using the current control power source unit, to perform electrolytic elution on the outermost surface of the precipitated low hardness chromium plating layer.

(4) The cathode and the anode were rapidly inverted and selective fixed current corresponding to 60 A/dm$^2$ was applied for 17 minutes using the current control power source unit, to precipitate a single layer of high hardness chromium plating layer on the single layer of the low hardness chromium plating layer.

(5) The cathode and the anode were rapidly inverted and a selective fixed current corresponding to 60 A/dm$^2$ was applied for one minute using the current control power source unit, to perform electrolytic elution on the outmost surface of the precipitated high hardness chromium plating layer.

(6) The cathode and the anode were rapidly inverted and a selective fixed current corresponding to 40 A/dm$^2$ was applied for three minutes using the current control power source unit, to precipitate a single layer of low hardness chromium plating layer on the high hardness chromium plating layer.

(7) Processes (3), (4), (5), and (6) were consecutively repeated until a laminated chromium plating layers having a predetermined thickness was obtained. Incidentally, the consecutive process was ended at the process (4).

The obtained laminated chromium plating layer is referred to as a sample No. 1, which was subjected to an abrasion test, a scuffing test, and a fatigue strength test.

Regarding testing machine and testing method in the abrasion test, Amsler type wear tester was used. A rotation piece was emerged about halfway in oil and brought into contact with a fixed piece which is the sample No.1, while a load was applied between the rotation piece and the fixed piece for the abrasion test. Abrasion amount ($\mu$m) of the rotation piece and the fixed piece was measured based on a step profile using a roughness tester. Here, the rotation piece corresponds to a cylinder liner, and the fixed piece corresponds to a piston ring to which the present embodiment is to be applied. Other testing conditions were as follows:

Opposing sliding member(rotation piece): FC25 (HRB 98)

Lubricating oil: Turbine oil (#100)

Oil temperature: 80° C.

Peripheral speed: 1m/sec (478 r.p.m.)

Load: 80 kg

Time: 7 hours

Regarding testing machine and method of the scuffing test, Amsler type wear tester was also used. The rotation piece was applied with oil and load was consecutively increased in a linear manner at a rate of 5 kg/min on the rotating piece until scuffing occurs. A load at which scuffing was generated is considered as a scuffing load. Other testing condition were as follows:

Opposing sliding member: FC25 (HRB 98)

Lubricating oil: spindle oil #2

Oil temperature: Left to vary according to course of test

Peripheral speed: 1 m/sec (478 rpm)

Regarding testing machine and method in a fatigue test, an actual ring-used fatigue testing machine was used. A predetermined load was repeatedly applied on the ring until breakage occurs. The ring was formed with a chromium plating according to the sample No. 1. A load was selected for repeated load application with repetition speed of 2000 cycles/min. If breakage of the ring does not occur at the load value and after repetition cycle of $10^7$ times, the load value is referred to as a fatigue strength. If breakage of the ring does not occur at the load value and after repetition cycle of $10^7$ times, the repetition cycle of more than $10^7$ times is regarded as less than the breakage limit at the load value. Testing results of Example 1 are shown in Table 1.

Comparative Example 1

A conventional single chromium plating layer was obtained as comparative example 1 by a continual film formation.

Regarding chromium plating conditions, a chromium plating bath ($CrO_3$:250 g/liter, $SO_4$:2.5/liter) was maintained at a fixed temperature of 55° C. A sodium silicofluoride additive was added to the chromium plating bath. The resultant chromium plating bath was used to perform chromium plating in the order of the following processes (1) to (2).

(1) First, with the base body as the anode and a counter electrode formed of a tin-lead alloy as the cathode, electrolytic polishing was performed on the outermost surface of the base body by using a current control power source unit to apply for one minute a selective fixed current corresponding to 60 A/dm$^2$, in order to perform electrolytic elution on the outermost surface of the base body.

(2) After (1), the cathode and the anode were rapidly inverted and selective fixed current corresponding to 60 A/dm$^2$ was applied using the current control power source unit to precipitate a high hardness chromium plating layer in a predetermined thickness.

The obtained chromium plating film was designated as sample No. 2 and the same abrasion test, scuffing test, and fatigue strength test as performed in the Example 1 was performed. The testing results are shown in Table 1.

Comparative Example 2

A conventional laminated chromium plating layers were obtained wherein each layer was configured with a thickness of 10 $\mu$m, and minute cracks were formed at a position between consecutive layers, each minute crack being independent in a thickness direction of each layer.

Regarding chromium plating conditions, a chromium plating bath ($CrO_3$:250 g/liter, $SO_4$:2.5/liter) was maintained at a fixed temperature of 55° C. A sodium silicofluoride additive was added to the chromium plating bath. The resultant chromium plating bath was used to perform chromium plating in the order of the following processes (1) to (4).

(1) First, with the base body as the anode and a tin-lead alloy counter electrode as the cathode, electrolytic polishing was performed on the outermost surface of the base body by way of electrolytic elution using a current control power source unit which applied for one minute a selective fixed current corresponding to 60 A/dm$^2$.

(2) Next, the cathode and the anode were rapidly inverted and selective fixed current corresponding to 60 A/dm$^2$ was applied for 17 minutes using the current control power source unit, to precipitate a single high hardness chromium plating layer.

(3) Next, the cathode and the anode were again rapidly inverted and selective fixed current corresponding to 60 A/dm$^2$ was applied for 1 minute using the current control power source unit, to perform electrolytic elution on the surface of the precipitated high hardness chromium plating layer.

(4) The processes (2) and (3) were consecutively repeated until a lamination structure of the chromium plating layers had a predetermined thickness. In this case, the layer formation process was completed at the process (2).

The obtained chromium plating layers was designated as sample No. 3 and the same abrasion test, scuffing test, and fatigue strength test as performed in the Example 1 was performed. The testing results are shown in Table 1.

Comparative Example 3

A conventional laminated chromium plating layers were obtained. In the conventional lamination, ceramic particles were held in minute cracks in each layer.

Regarding chromium plating conditions, a chromium plating bath ($CrO_3$:250 g/liter, $SO_4$:2.5/liter) was maintained at a fixed temperature of 55° C. A sodium silicofluoride additive and a suspension of ceramic particles having particle diameters of 0.05–1.0 $\mu$m with suspension density of 100 g/liter were added to the chromium plating bath. The resultant chromium plating bath was used to perform chromium plating in the order of the following processes (1) to (4) while agitating the bath liquid for aeration.

(1) First, with the base body as the anode and a tin-lead alloy counter electrode as the cathode, electrolytic polishing was performed by performing elution on the outermost surface of the base body using a current control power source unit which applied for one minute a selective fixed current corresponding to 60 A/dm$^2$.

(2) Next, the cathode and the anode were rapidly inverted and selective fixed current corresponding to 60 A/dm$^2$ was applied for 17 minutes using the current control power source unit, to precipitate a high hardness chromium plating layer in a predetermined thickness.

(3) Next, the cathode and the anode were again rapidly inverted and selective fixed current corresponding to 60 A/dm$^2$ was applied for 1 minute using the current control power source unit, to perform electrolytic elution on the surface of the precipitated high hardness chromium plating layer.

(4) Processes (2) and (3) were continuously repeated and was ended at process (2) until an entire lamination had a predetermined thickness.

The obtained lamination structure was designated as sample No. 4 and the same abrasion test, scuffing test, and fatigue strength test as performed in the Example 1 was performed. The testing results are shown in Table 1.

According to Table 1 below, abrasion amount of the fixed piece in the sample No.1 is approximately equal to the abrasion amount of the fixed pieces in the sample Nos. 2 and 3. Further, abrasion amount of the rotation piece in the sample No.1 is approximately equal to the abrasion amount of the rotation pieces in the sample Nos. 2 and 3. However, the sample No. 4 has a strikingly large abrasion amount of the rotation piece, although the abrasion amount of the fixed piece is small. Therefore, the sample No. 4 seems to be unavailable as a practical internal combustion engine.

Viewing the results of the scuffing test, the scuff generating load of the sample No. 1 is slightly lower than the scuff generating load of the samples 3 and 4, but is superior to that of sample No. 2. However, as long as anti-scuffing characteristic is 90 kg or greater, there is no problem in use for an actual engine.

Viewing the results of the fatigue strength test, the sample No. 1 has a much better fatigue strength than that of the other samples, so is superior for use in an actual engine. The sample No. 4 shows a low value for fatigue strength and so has problems for use in an actual high load type engine.

By an overall evaluation of the test results, it can be understood that the sample No. 1, that is, the chromium plating layers according to the present embodiment is superior to the conventional examples. Incidentally, in Table 1, a circle, a triangle and "X" imply "good performance", "intermediate performance" and "bad performance", respectively, for use as components of an internal combustion engine, such as piston rings and cylinder liners.

According to the present invention, because of the alternating arrangement of the high hardness layer and the low hardness layer, each hard layer (high hardness layer) can be supported by each cushioning layer (low hardness layer), which provides synergetic effect in terms of co-provision of sufficient wear resistance and sufficient fatigue strength.

While the invention has been described in detail and with reference to the specific embodiment thereof, it would be apparent to those skilled in the art that various changes and modifications may be made therein without departing from the scope of claims.

TABLE 1

| | ABRASION TEST | | | | | |
|---|---|---|---|---|---|---|
| SAMPLE NO. | ABRASION AMOUNT OF FIXED PIECE (μm) | ABRASION AMOUNT OF ROTATION PIECE (μm) | SCUFFING TEST LOAD THAT GENERATED SCUFFING (kg) | FATIGUE TEST FATIGUE STRENGTH (kg) | OVERALL EVALUATION | EXAMPLE |
| 1 | 1.529 | 0.261 | 96 | 112 | ○ | EXAMPLE 1 |
| 2 | 1.39 | 0.29 | 80 | 70 | X | COMPARATIVE EXAMPLE 1 |
| 3 | 1.523 | 0.251 | 104 | 77 | Δ | EXAMPLE 2 |
| 4 | 0.9035 | 0.464 | 112 | 42 | X | COMPARATIVE EXAMPLE 3 |

What is claimed is:

1. A lamination of chromium plating layers formed on a surface of a base body to be plated, the lamination comprises:

a plurality of high hardness chromium plating layers;

a plurality of low hardness chromium plating layers with hardness lower than that of the high hardness chromium plating layers, each high hardness chromium plating layer being formed upon each low hardness chromium plating layer to provide the lamination of an alternating high hardness chromium plating and low hardness chromium plating layer; and wherein each high hardness chromium plating layer has a thickness greater than that of each low hardness chromium plating layer.

2. The lamination of chromium plating layers as claimed in claim 1, wherein each high hardness chromium plating layer has a thickness ranging from 2 to 50 μm, and each low hardness chromium plating layer has a thickness ranging from 0.1 to 40 μm.

3. The lamination of chromium plating layers as claimed in claim 1, wherein the high hardness chromium plating layers have a hardness ranging from Hv750 to Hv1200.

4. The lamination of chromium plating layers as claimed in claim 1, wherein the high hardness chromium plating layer is formed directly on the surface of the base body as a first layer, the first layer having a thickness ranging from 0.1 to 50 μm, whereby a top surface portion of the lamination provides a toughness greater than that of a remaining part of the lamination.

5. The lamination of chromium plating layers as claimed in claim 1, wherein the low hardness chromium plating layer is formed directly on the surface of the base body as a first layer, the first layer having a thickness ranging from 0.1 to 50 μm, whereby a toughness of entire lamination can be improved.

* * * * *